US005765096A

United States Patent [19]

Ishiyama

[11] Patent Number: 5,765,096

[45] Date of Patent: Jun. 9, 1998

[54] METHOD FOR PRODUCING NICKEL-ALUMINUM INTERMETALLIC COMPOUNDS CONTAINING DOPANT ELEMENTS

[75] Inventor: Shintaro Ishiyama, Ibaraki-ken, Japan

[73] Assignee: Japan Atomic Energy Research Institute, Tokyo, Japan

[21] Appl. No.: 865,143

[22] Filed: May 29, 1997

Related U.S. Application Data

[62] Division of Ser. No. 583,626, Jan. 5, 1996, Pat. No. 5,698,006.

[30] Foreign Application Priority Data

Sep. 2, 1995 [JP] Japan ..... 7-22055

[51] Int. Cl.[6] ..... B22F 3/15

[52] U.S. Cl. ..... 419/28; 419/49; 419/54

[58] Field of Search ..... 419/28, 49, 54; 148/409, 427; 75/254, 244, 249

[56] References Cited

U.S. PATENT DOCUMENTS

| | | | |
|---|---|---|---|
| 3,554,740 | 1/1971 | Williams et al. | 419/28 |
| 4,340,425 | 7/1982 | Barrett et al. . | |
| 4,661,156 | 4/1987 | Chang et al. | 419/49 |
| 4,707,332 | 11/1987 | Huether | 419/28 |
| 4,731,221 | 3/1988 | Liu . | |
| 5,015,440 | 5/1991 | Bowden | 419/28 |
| 5,032,353 | 7/1991 | Smarsly et al. | 419/28 |
| 5,116,691 | 5/1992 | Darolia et al. . | |
| 5,445,790 | 8/1995 | Hu et al. | 419/54 |

FOREIGN PATENT DOCUMENTS

| | | |
|---|---|---|
| 3935496 | 7/1990 | Germany . |
| 58-27946 | 2/1983 | Japan . |
| 61-113741 | 5/1986 | Japan . |
| 63-235444 | 9/1988 | Japan . |
| 4-28832 | 1/1992 | Japan . |
| 6-2061 | 1/1994 | Japan . |

OTHER PUBLICATIONS

S. Ishiyama et al., "The Characteristics of Hot Swaged NiAl Intermetallic Compounds with Ternary Additions Consolidated by HIP Techniques", *Synthesis/Processing of Lightweight Metallic Materials,* Feb.13–16, 1995, pp. 323–330.

*Primary Examiner*—Margery Phipps
*Attorney, Agent, or Firm*—Banner & Witcoff

[57] ABSTRACT

A method for producing a space shuttle or nuclear reprocessing structural material of an intermetallic compound having a formula NiAl+xMoRe+cB, wherein the atomic ratio of Ni:Al is 56.5:43.5, the atomic ratio of Mo:Re is 1:1, or 1:0.5, x is between 0.1 and 1 at. %, and c is from 0 to 0.2 at. %, including the steps of:

mixing Ni and Al powders in the atomic ratio of 56.5:43.5 in an inert gas adding thereto between 0.1 and 1 at. % total of Mo and Re powders in an atomic ratio of 1:1 or 1:0.5 and from 0 to 0.2 at. % of B and mixing to obtain a uniform powder mixture, packing the mixture in a steel capsule to obtain a packed mixture, and Hot Isostatically Pressing the packed mixture at a temperature from 1000° to 1200° C. with 200 MPA pressure to obtain a pressed material, swaging the pressed material to at least 90% theoretical reduction, and obtaining the material having a uniform and refined structure.

1 Claim, 15 Drawing Sheets

METHOD FOR PRODUCING NICKEL-ALUMINUM INTERMETALLIC COMPOUNDS CONTAINING DOPANT ELEMENTS

This application is a divisional of application Ser. No. 08/583,626, filed Jan. 5, 1996 now U.S. Pat. No. 5,698,006.

BACKGROUND OF THE INVENTION

This invention relates to intermetallic compounds that are lightweight and that have satisfactory oxidation resistance and high-temperature strength. The applicability of these intermetallic compounds is wide enough to extend to aerospace (as in space shuttle structural materials) and nuclear fields (as structural materials for use in reprocessing facilities).

Conventional NiAl intermetallic compounds have a hard and brittle nature which is attributable to intermetallic compounds in general. Materials having this nature are typically used as coating materials but their use as structural materials has been limited since their ductility at low temperature is insufficient to warrant machining and other processings.

In order for NiAl intermetallic compounds to be used as structural materials on a large scale, it is necessary that structural materials comprising them not only have sufficient ductility to withstand machining at low temperature but also exhibit good mechanical strength at high temperature.

SUMMARY OF THE INVENTION

The present invention has been accomplished under these circumstances and has as an object providing materials comprising NiAl intermetallic compounds that are improved to have not only satisfactory ductility at low temperature but also satisfactory strength at high temperature.

The invention attains this object by adding small amounts of a third element A, a fourth element Y or a fifth element Z as dopant elements X to NiAl intermetallic compounds. Materials comprising the resulting compounds retain the lightweightness and corrosion resistance which are characteristics of the initial NiAl intermetallic compounds and are yet improved in low-temperature ductility and high-temperature strength.

DETAILED DESCRIPTION OF THE INVENTION

Figure 1A:
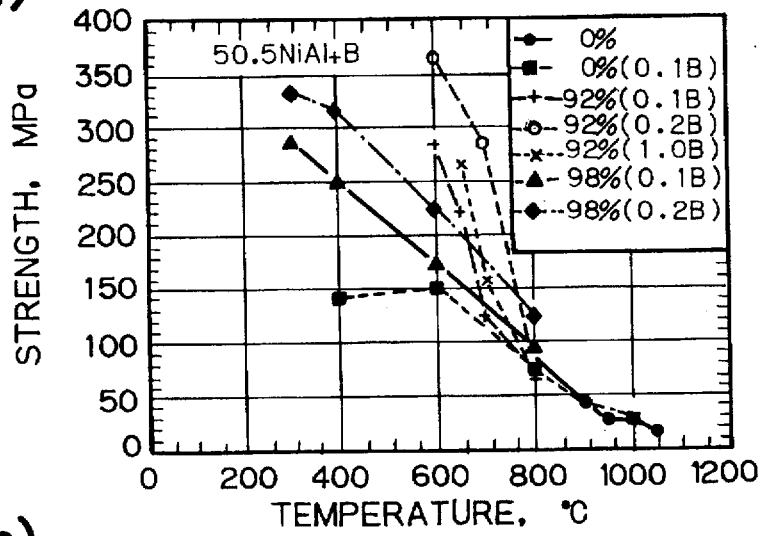
FIGS. 1*a*, 1*b* and 1*c* are graphs showing the high-temperature strength characteristic of swaged samples of alloy materials xNiAl+B.

NiAl intermetallic compounds having dopant element X added in small amounts typically have such compositions that the ratio of Ni to Al is in the range from 50:50 to 63.5:37.5. Dopant element X is at least one member of the group consisting of molybdenum, tungsten, rhenium, ruthenium and boron; X may be added as alloys of these elements. The intermetallic compounds of the invention typically have the composition represented by NiAl+aA+bY+cZ. The prefix a signifies the amount of addition of the third element A, which ranges from 0.1 at. % to 1 at. %. The fourth element Y is other than the third element A and the prefix b signifies the amount of its addition, which ranges up to 50 at. % of the total content of X. The fifth element Z is primarily boron (B) and the prefix c signifies the amount of its addition, which ranges from 0 to 0.2 at. %. A most representative composition of the intermetallic compounds of the invention is 56.5 NiAl+(1.0 Mo/0.5 Re)+0.2 B.

In the invention, starting materials for a specific intermetallic compound are subjected to various techniques of the melting process or powderizing process (e.g. gas atomizing) to prepare cast alloys or mixed metal powders; the cast alloys are given uniform working pressure by special hot forging techniques such as swaging, and the mixed metal powders are worked by the combination of a powder metallurgical method (HIP, or hot isostatic pressing) and hot forging (swaging), so as to provide materials having a uniform and refined structure. Those materials which have Mo and other elements added as X to NiAl and which have a refined structure are highly ductile at room temperature and exhibit satisfactory mechanical strength at high temperature.

When hot forging the cast alloys by swaging, the alloys are coated with a highly ductile material and first worked to 75% forging at 1100° C., then up to 98% forging at 900° C., thereby producing materials having a uniform and refined structure. It should be noted that the forging ratio per cycle is 0.5%.

When processing the mixed metal powders by the combination of a powder metallurgical method (HIP) and hot forging (swaging), a stainless steel or highly ductile steel encapsulant is packed with a compact that is prepared by densifying the mixed metal powder through CIP (cold isostatic pressing) to at least 70% of the theoretical, and the compact is sintered at a temperature of 1000°–1250° C. and a pressure of 100–200 MPa, followed by forging to produce a material having a uniform and refined structure.

EXAMPLES

The invention will now be described in greater detail by reference to the following examples which are provided for illustrative purposes only and are by no means limiting.

Nickel (99.9% pure) and aluminum (99.9% pure) powders were mixed at atomic ratios ranging from 50:50 to 63.5:37.5 in an inert gas while a dopant or dopants were added in amounts of 0.1–1 at. % to provide uniform powder mixtures. Subsequently, either one of the following procedures was taken.

(1) The powder mixture was placed in a mold and pressurized to make a preform, which was vacuum packed and processed by CIP (the preform in a pressure container containing a pressure-transmitting medium such as water was given isostatic compressive load that was created by externally pressurizing the medium) to make a dense compact, which was then vacuum-sealed in a HIP encapsulant and subjected to HIP.

(2) The powder mixture was directly vacuum-sealed in a HIP encapsulant and subjected to HIP.

The HIP encapsulant is made of materials that will not fuse in the temperature range for HIP and that yet will not react with the powders consisting of Ni, Al and dopants. When selecting suitable encapsulant materials, check must be made against the data on-the high-temperature strength of candidate materials within the range of temperatures at which HIP is to be performed, as well as by experimentation or against existing data on the reactivity of candidate materials with the elements that are to be subjected to HIP.

After HIP, the encapsulants were individually heated to a forging temperature (900°–1100° C.) and immediately thereafter, the HIP products were sent into a swaging apparatus together with the heated encapsulants so that uniform forging was effected. The heating and forging process was continued until the materials were worked to the specified degree. Swaging is a process of working a cylindrical test piece with three or four anvils that are applied to separate points on the circumference of the test piece and which are vibrated at high speed to create radial isostatic forces on the test piece.

Tables 1 and 2 show the results of swaging alloy materials NiAl+X that were prepared by doping starting NiAl alloys with various elements (Ti, Fe, V, W, Cr, Cu, Mo, Nb, Ta, Hf, Zr and B). The data verify the types of dopants that are effective in rendering the NiAl alloys to be capable of withstanding working up to 98% forging, as well as the necessary amounts of doping.

TABLE 1

Boron Doping and Conditions of Hot Forging

| xNiAl | B addition, at.% | Amount of forging, % | State of forging |
|---|---|---|---|
| 47.5 | 0 | 0 | |
| 50.5 | 0 | 0 | |
| | 0.1 | 0 | |
| | | 92 | o |
| | | 98 | o |
| | 0.2 | 92 | o |
| | | 98 | o |
| | 0.5 | 94 | x |
| | 1.0 | 92 | x |
| | | 94 | x |
| 53.5 | 0 | 0 | |
| | 0.1 | 0 | |
| 56.5 | 0 | 0 | |
| | 0.1 | 98 | x |
| | 0.2 | 98 | x |
| | 0.5 | 97 | o |
| | 1.0 | 98 | o |
| 61.5 | 0 | 0 | |
| | 0.1 | 0 | |
| 63.5 | 0 | 0 | |
| | 0.1 | 0 | |
| | 0.2 | 92 | o |
| | 1.0 | 92 | o |

o: good
x: poor

TABLE 2

Third Dopant Element and Conditions of Hot Forging

| x-NiAl | Addition of third dopant element, at.% | Amount of forging, % | State of forging |
|---|---|---|---|
| 50.5 | Ti/1.0 | 90 | x |
| | Fe/1.0 | 91 | x |
| | V /1.0 | 92 | x |
| | W /0.1 | 90 | x |
| | 0.2 | 89 | x |
| | 0.5 | 97 | o |
| | 1.0 | 97 | o |
| | Cr/1.0 | 91 | x |
| | Cu/1.0 | 91 | x |
| | Mo/1.0 | 90 | x |
| | Nb/1.0 | 91 | x |
| | Ta/1.0 | 97 | o |
| | Hf/1.0 | 98 | o |
| | Zr/1.0 | 90 | x |
| | B /0.1 | 98 | o |
| | 0.2 | 98 | o |
| | 0.5 | 94 | x |
| | 1.0 | 94 | x |
| 56.5 | Ti/1.0 | 90 | x |
| | Fe/1.0 | 92 | x |
| | V /1.0 | 98 | x |
| | W /1.0 | 90 | o |
| | Cr/1.0 | 92 | o |
| | Cu/1.0 | 92 | x |
| | Mo/1.0 | 98 | o |
| | Nb/1.0 | 98 | o |
| | Ta/1.0 | 97 | o |
| | Hf/1.0 | 98 | o |
| | Zr/1.0 | 98 | o |
| | B /0.1 | 91 | x |
| | 0.2 | 92 | x |
| | 0.5 | 97 | o |
| | 1.0 | 98 | o |
| 63.5 | Ti/1.0 | 0 | |
| | Fe/1.0 | 0 | |
| | V /1.0 | 0 | |

TABLE 2-continued

Third Dopant Element and Conditions of Hot Forging

| x-NiAl | Addition of third dopant element, at.% | Amount of forging, % | State of forging |
|---|---|---|---|
| | W /1.0 | 0 | |
| | Cr/1.0 | 0 | |
| | Cu/1.0 | 0 | |
| | Mo/1.0 | 0 | |
| | B /0.2 | 92 | o |
| | 1.0 | 92 | o |

o: good
x: poor

Figure 1B:
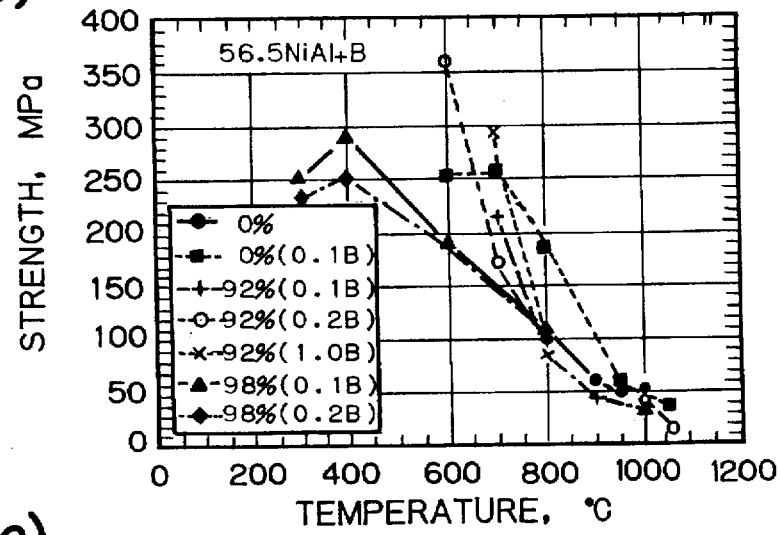
Figure 1C:
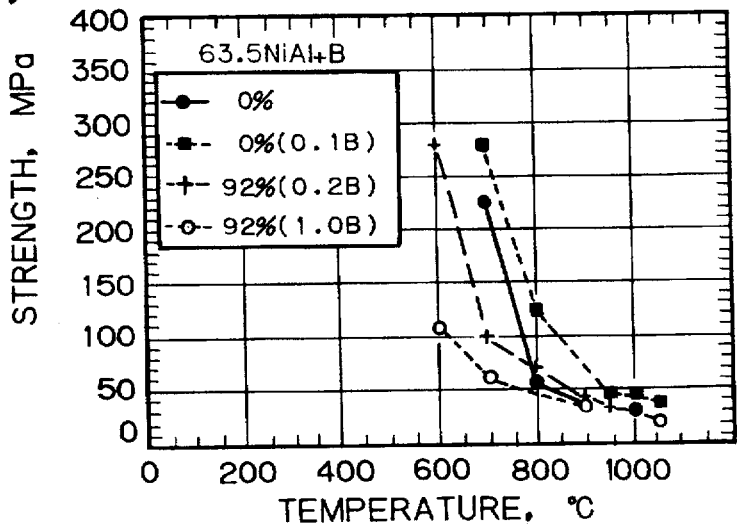

FIGS. 1*a*–1*c* show that the high-temperature strength of alloy materials xNiAl+B forged by swaging increased as their structure became finer with the progress of forging and that the temperature at which the strength peaked shifted to the lower side. Maximum values of high strength were obtained when the B addition was 0.2 at. %.

Figure 2A:
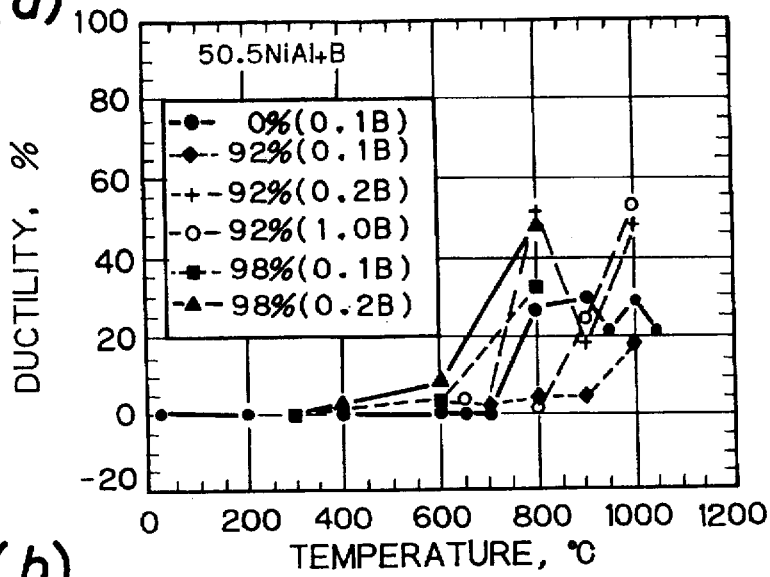
FIGS. 2*a*, 2*b* and 2*c* are graphs showing the ductility characteristic of swaged samples of alloy materials xNiAl+B.
Figure 2B:
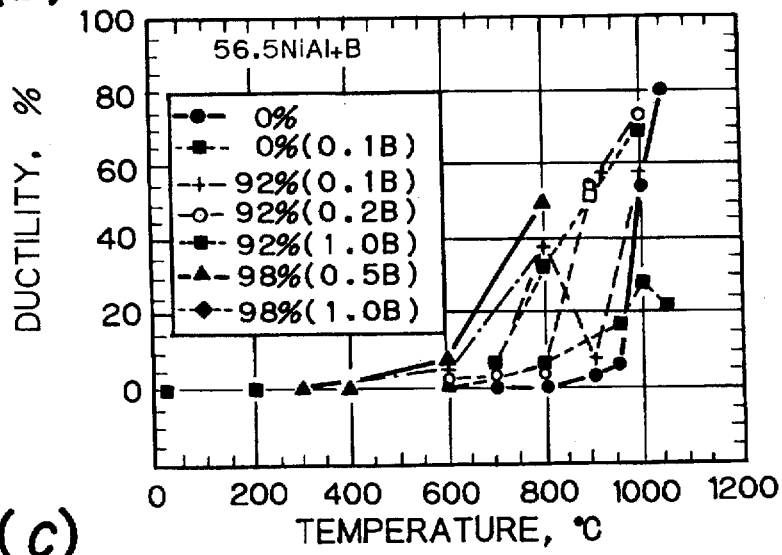
Figure 2C:
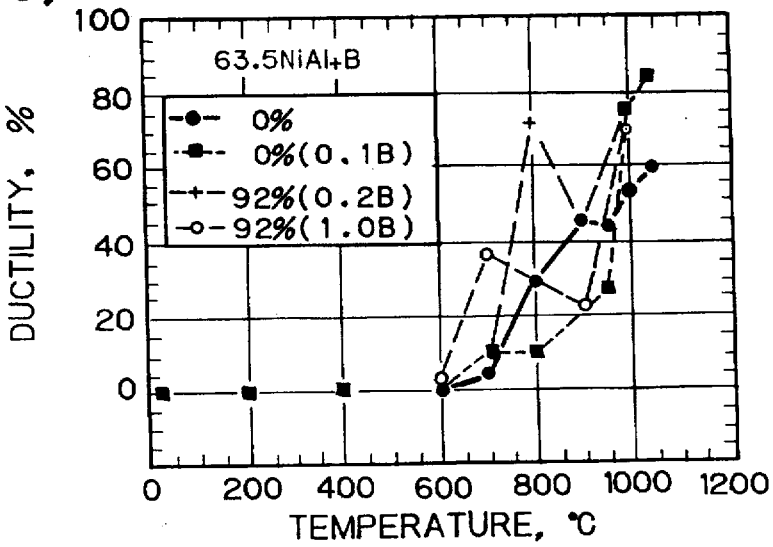

FIGS. 2*a*–2*c* show that the ductile brittleness transition temperature (hereunder DBTT) of alloy materials xNiAl+B forged by swaging decreased to 300° C. with the progress of forging.

Figure 3A:
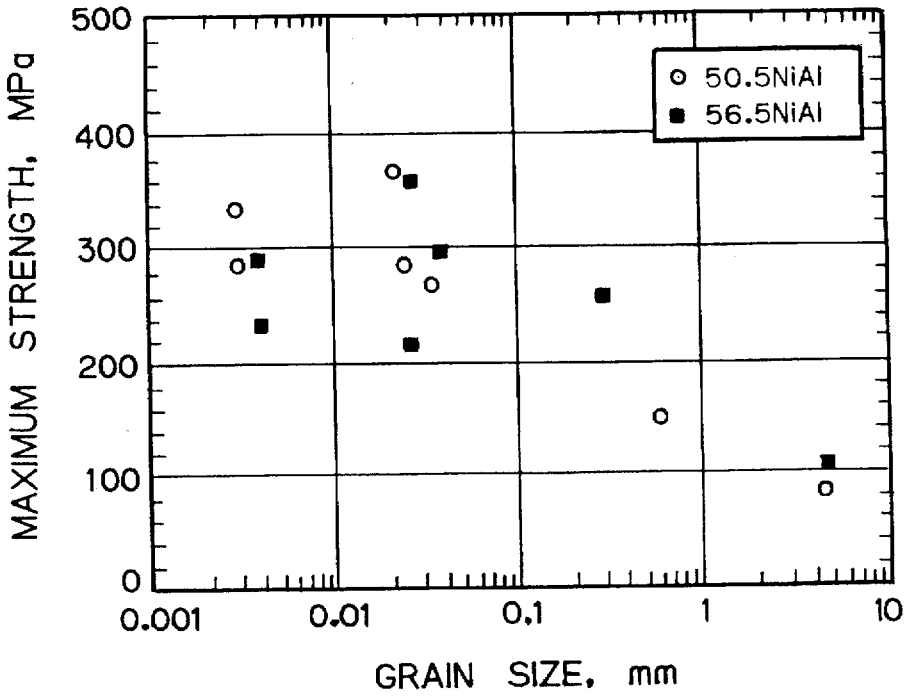
FIG. 3*a* is a graph showing the relationship between the grain size and high-temperature strength of swaged samples of alloy materials xNiAl+B.
Figure 3B:
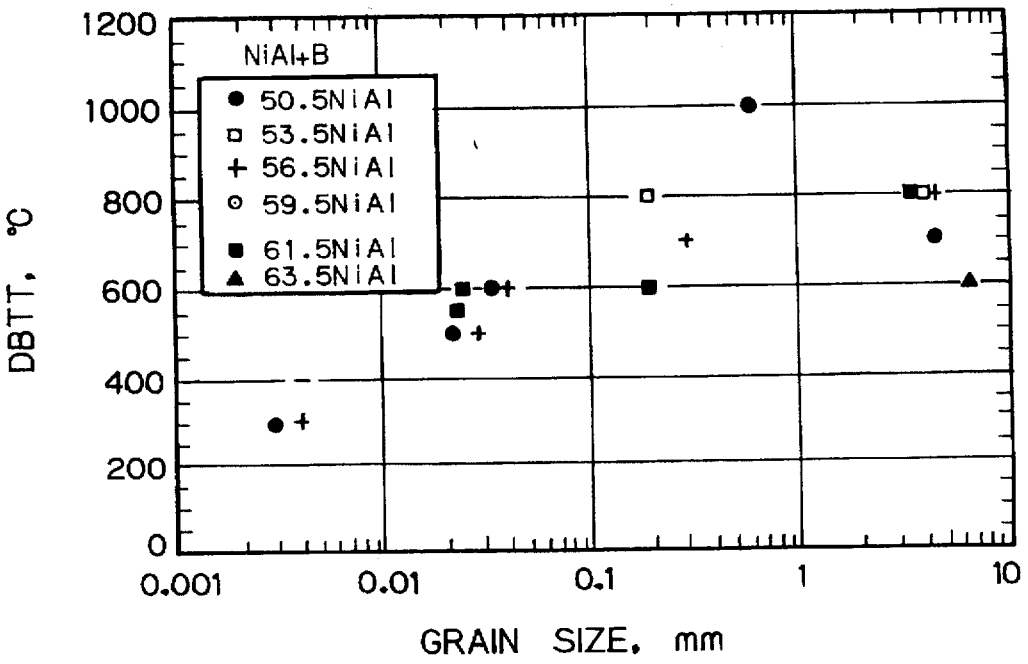
FIG. 3*b* is a graph showing the relationship between the grain size and DBTT of swaged samples of alloy materials xNiAl+B.

FIGS. 3*a* and 3*b* show that as the grain size of alloy materials xNiAl+B forged by swaging became finer, their high-temperature strength increased (but decreased when the grain size was as small as a few microns) and the DBTT decreased linearly. It is therefore expected that the DBTT will decrease down to room temperature with alloys having a superfine structure less than 100 nm in grain size.

Figure 4A:
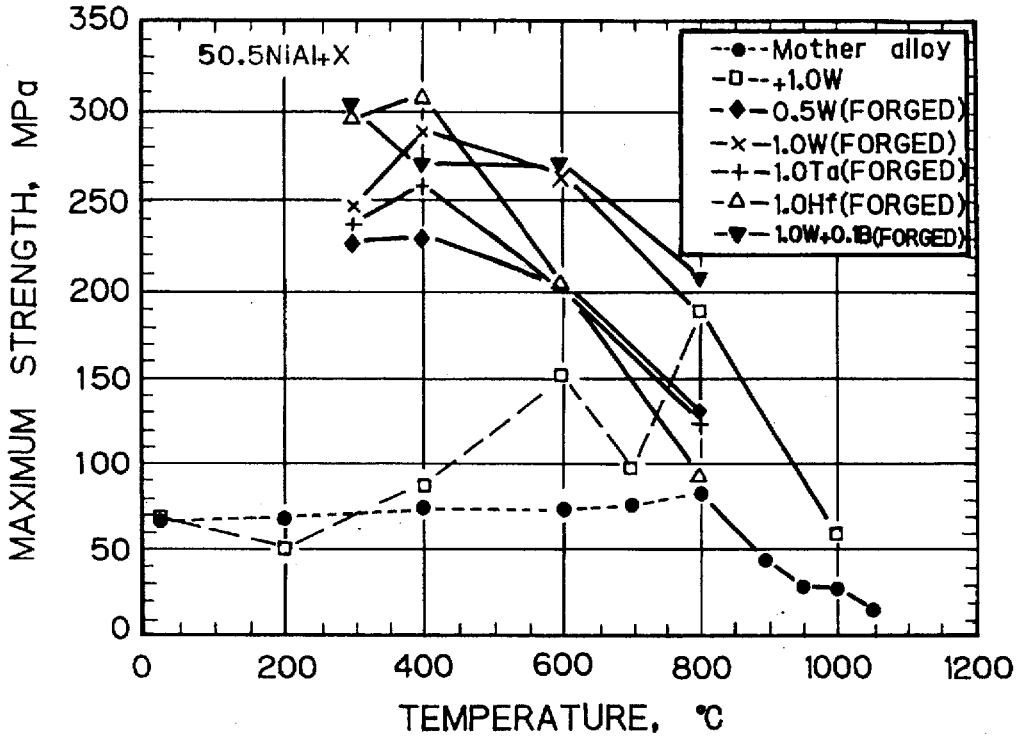
FIGS. 4*a* and 4*b* are graphs showing the high-temperature characteristic of swaged samples of alloy materials xNiAl+aB.
Figure 4B:
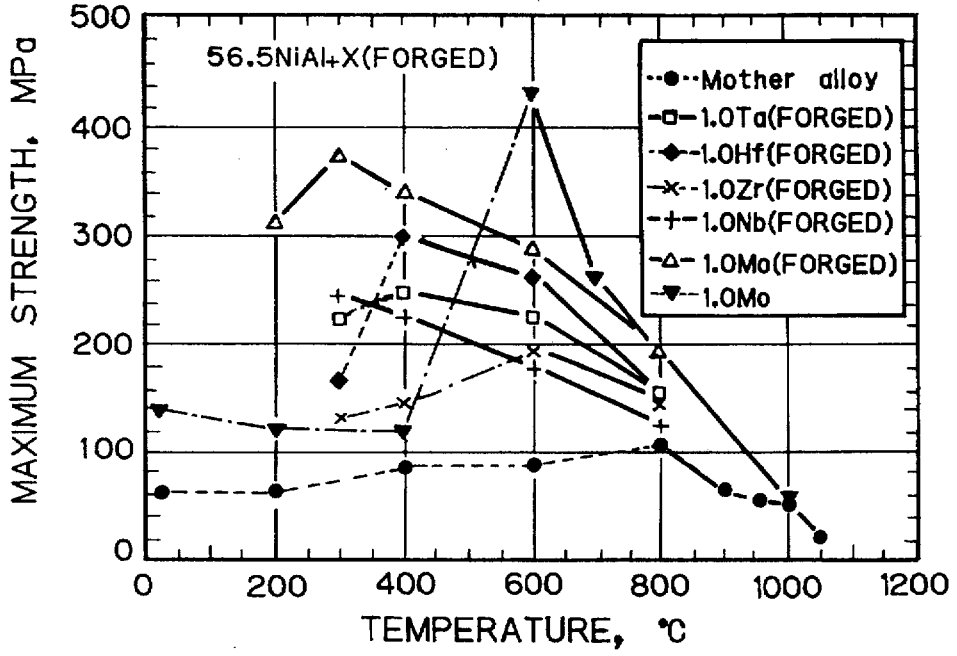

FIGS. 4*a* and 4*b* show-that alloy materials xNiAl+X forged by swaging were characterized not only by the decrease in the temperature at which the high-temperature strength peaked but also by the increase in high-temperature strength when Mo or W was added as X.

Figure 5A:
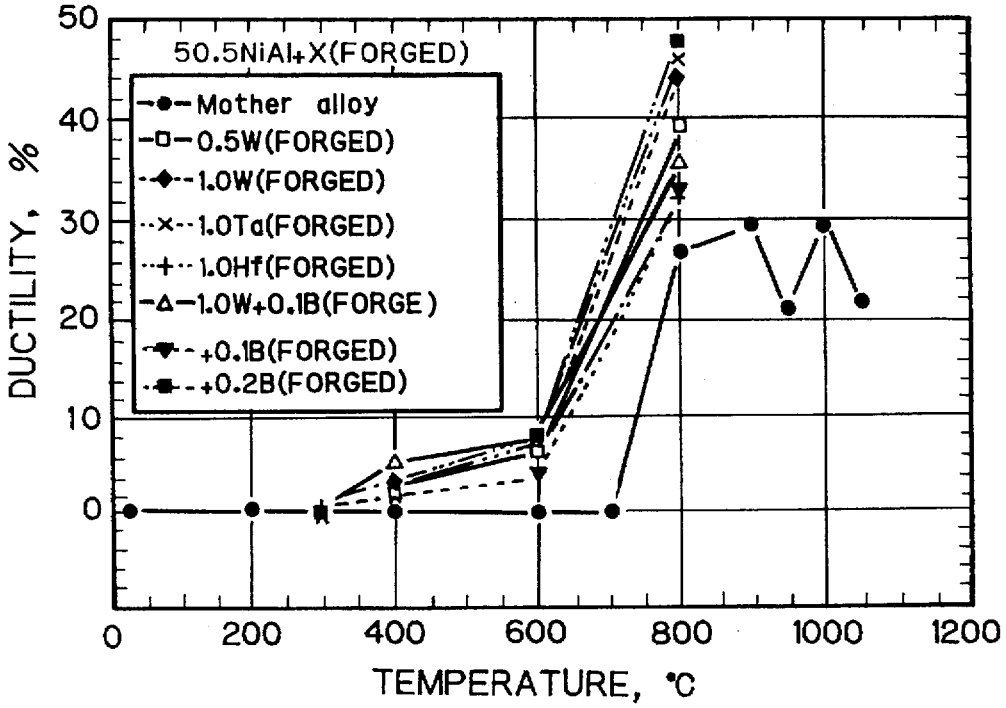
FIGS. 5*a* and 5*b* are graphs showing the ductility characteristic of swaged samples of alloy materials xNiAl+aB.
Figure 5B:
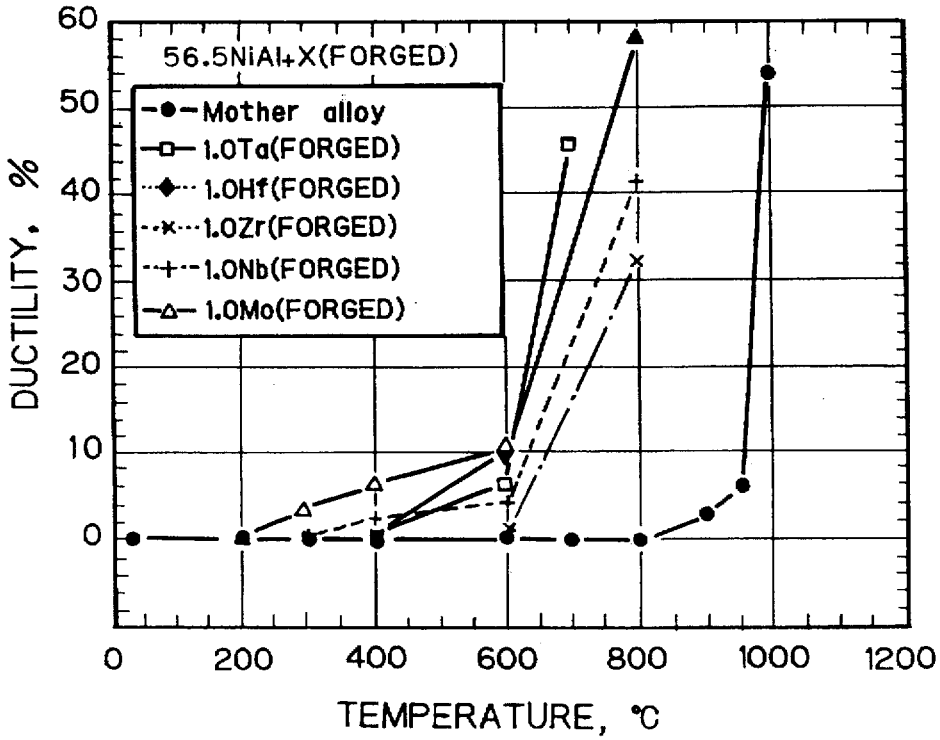

FIGS. 5*a* and 5*b* show that alloy materials xNiAl+X forged by swaging had their DBTT lowered to 200° C. when Mo or W was added as X.

Figure 6A:
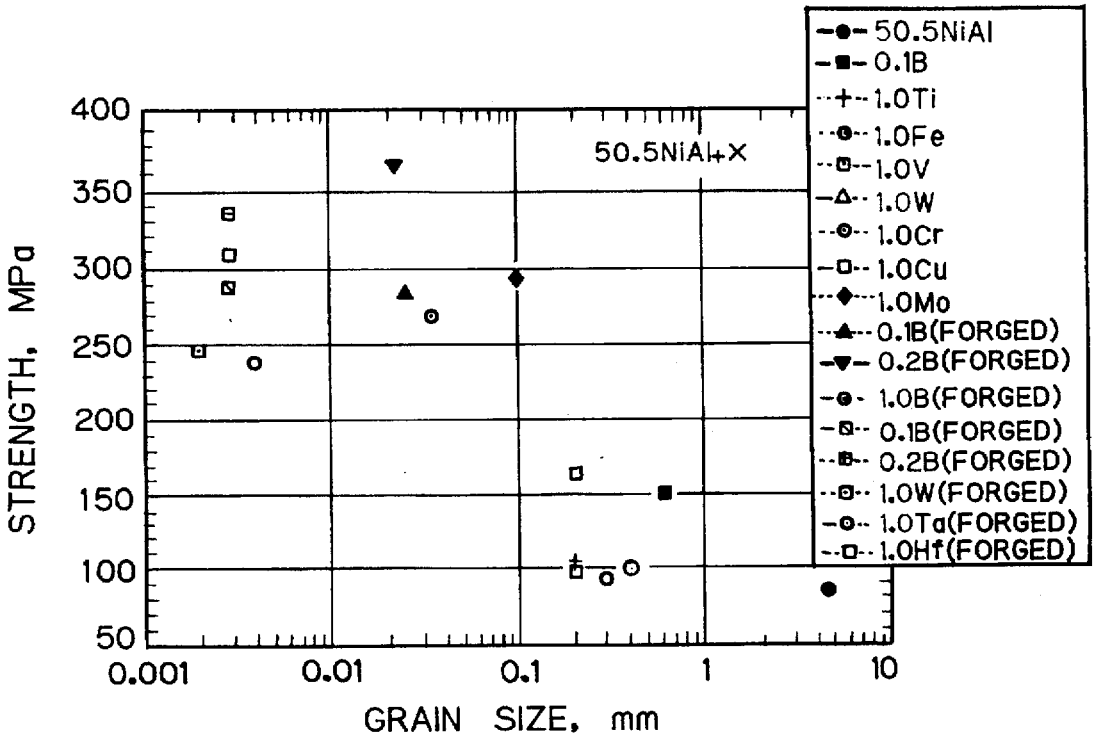
FIGS. 6*a* and 6*b* are graphs showing the relationship between the grain size and high-temperature strength of swaged samples of alloy materials xNiAl+aB.
Figure 6B:
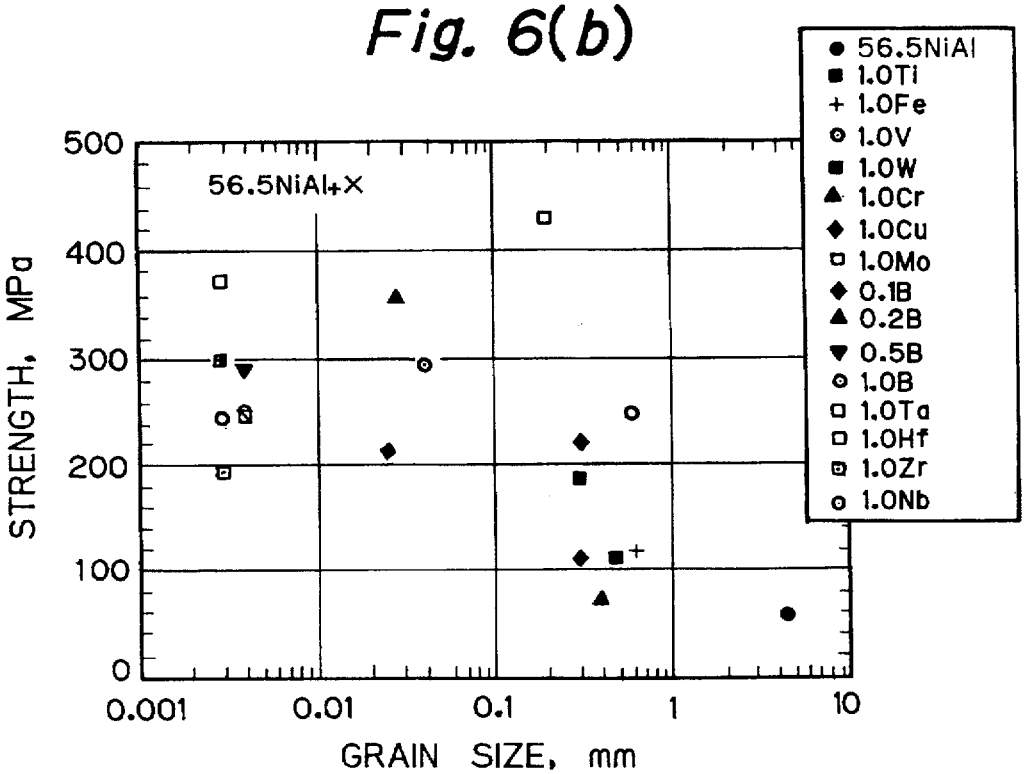
Figure 7A:
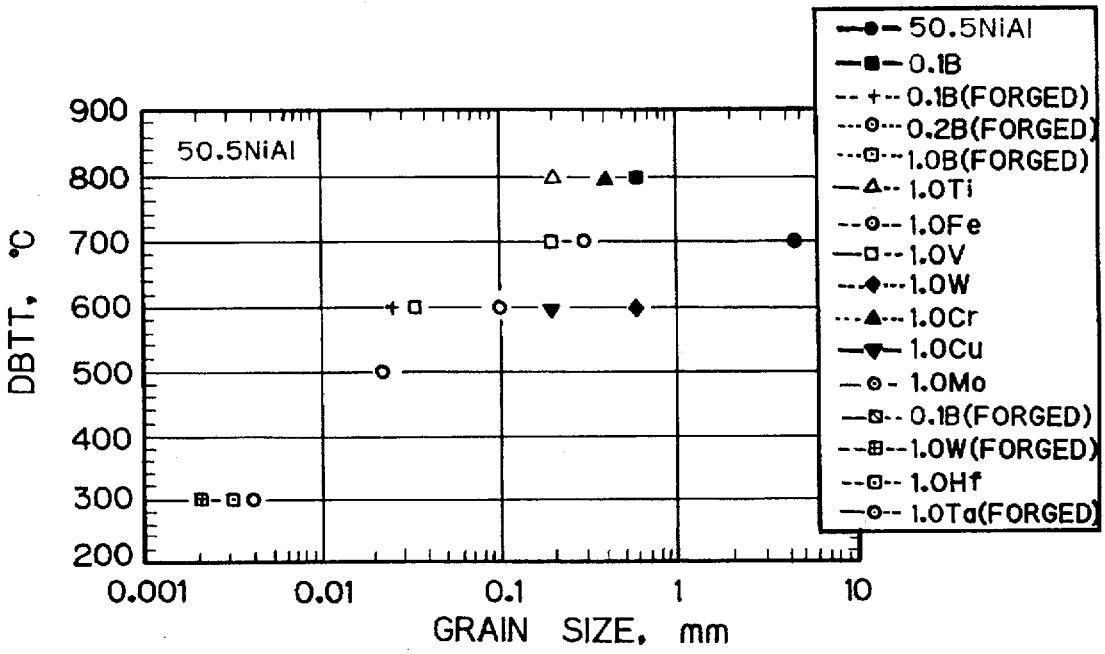
FIGS. 7*a* and 7*b* are graphs showing the relationship between the grain size and DBTT of swaged samples of alloy materials xNiAl+aB.
Figure 7B:
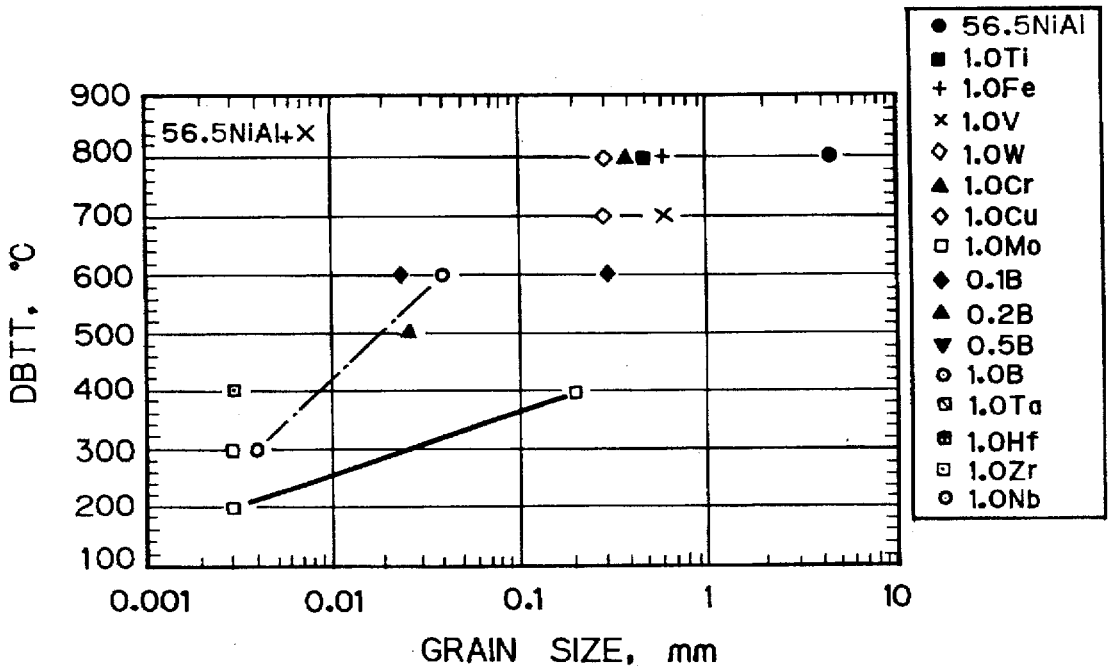
Figure 8A:
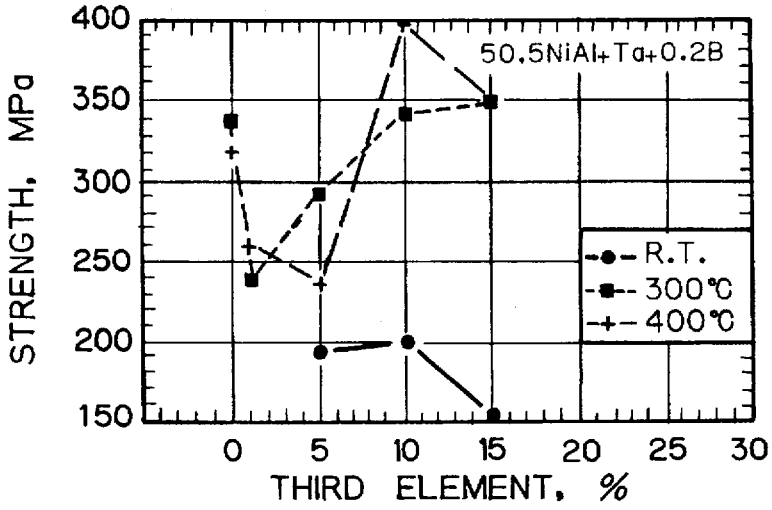
FIGS. 8*a*, 8*b*, 8*c* and 8*d* are graphs showing the high-temperature characteristic of swaged samples of alloy materials xNiAl+aX+0.2 B, with Mo or W being added as X in amounts of up to 20 at. %.
Figure 8B:
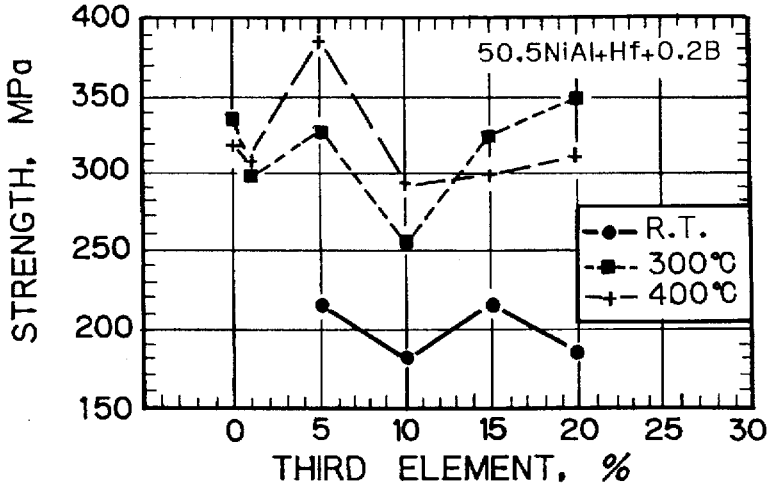
Figure 8C:
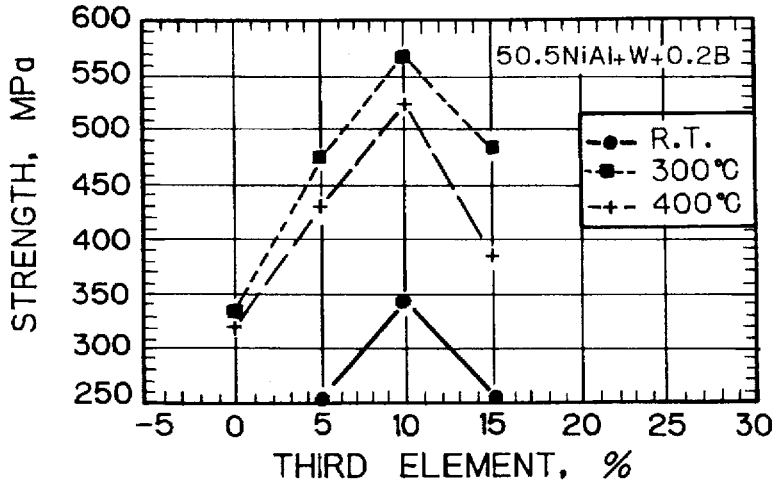
Figure 8D:
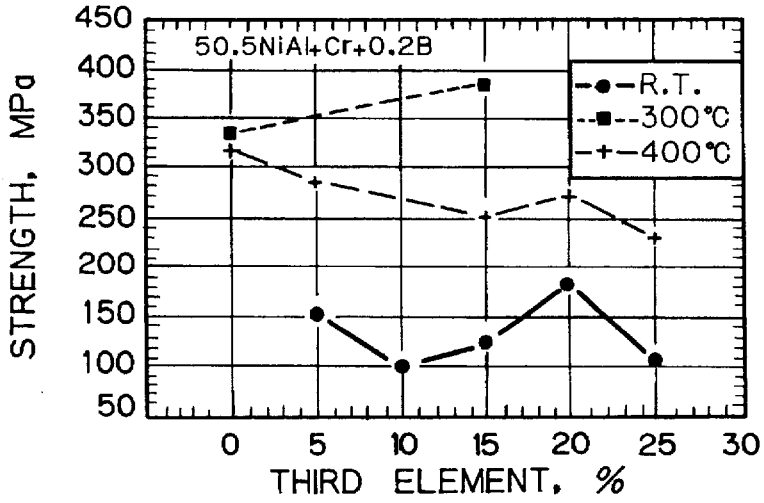
Figure 8E:
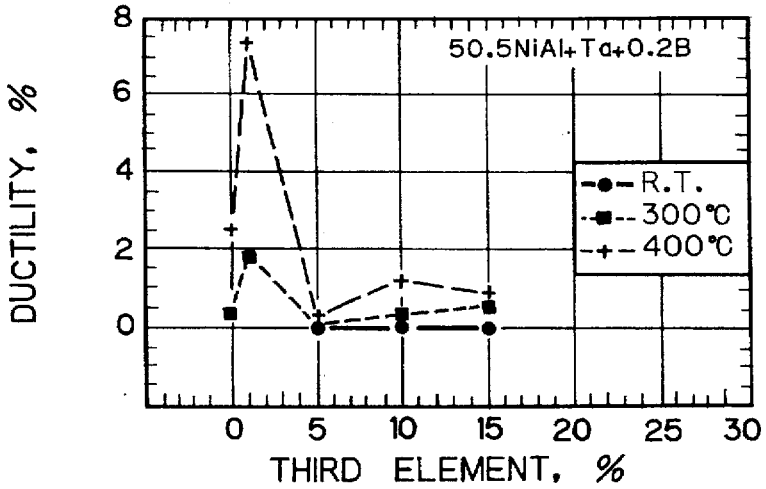
FIGS. 8*e*, 8*f*, 8*g* and 8*h* are graphs showing the ductility characteristic of swaged samples of alloy materials xNiAl+aX+0.2 B, with Mo or W being added as X in amounts of up to 20 at. %.
Figure 8F:
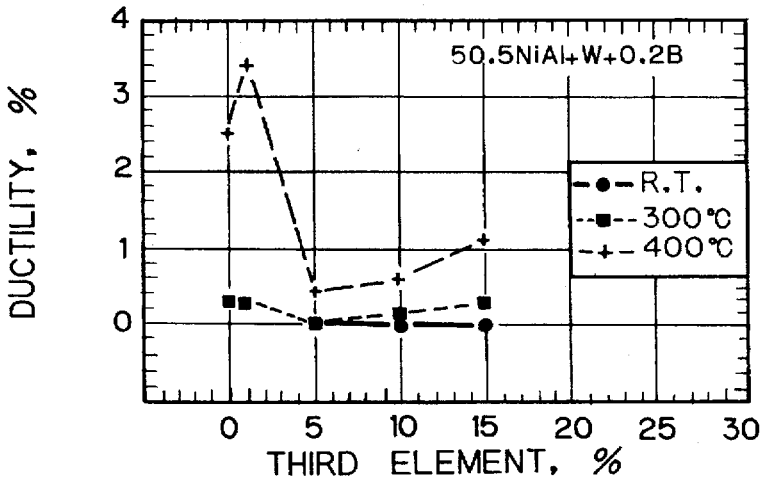
Figure 8G:
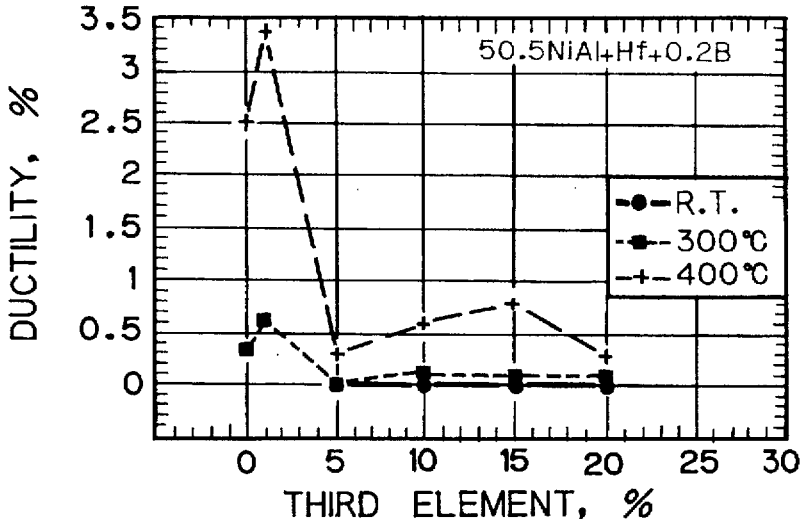
Figure 8H:
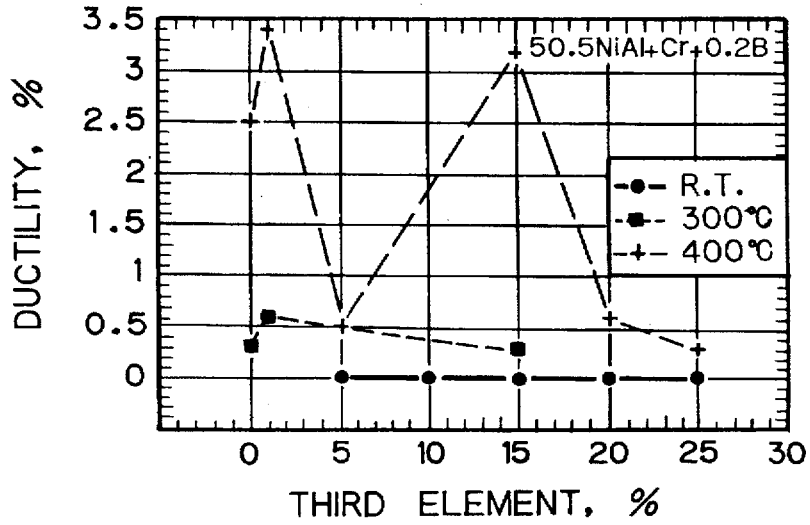
Figure 9A:
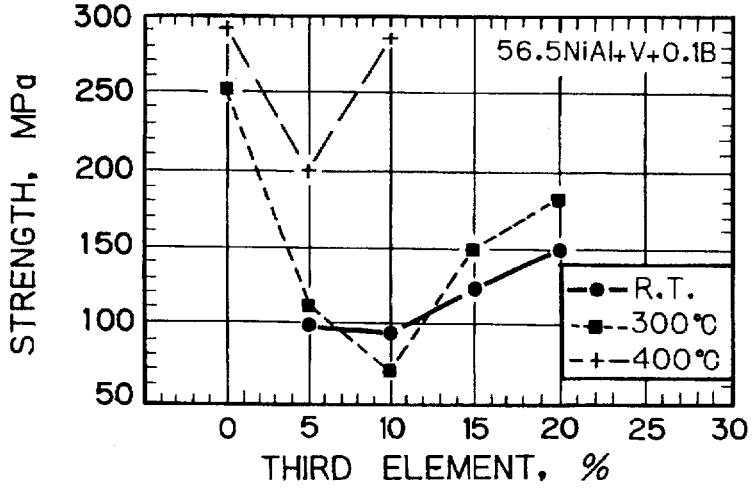
FIGS. 9*a*, 9*b*, 9*c* and 9*d* are graphs showing the high-temperature characteristic of swaged samples of alloy materials xNiAl+aX+0.1 B, with Mo or W being added as X in amounts of up to 20 at. %.
Figure 9B:
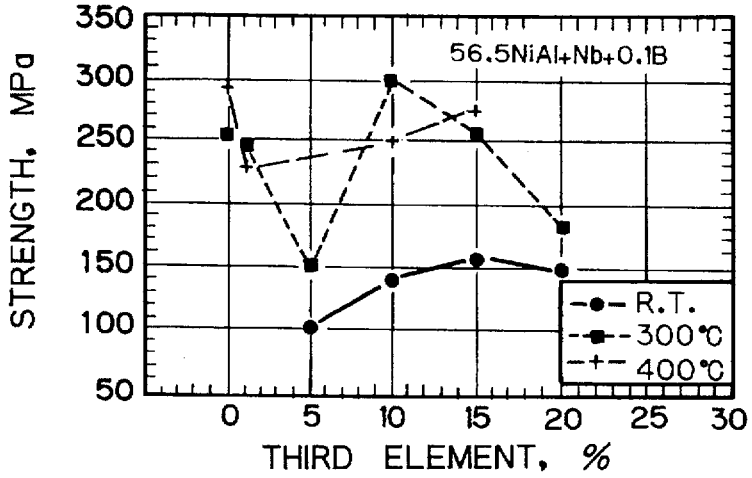
Figure 9C:
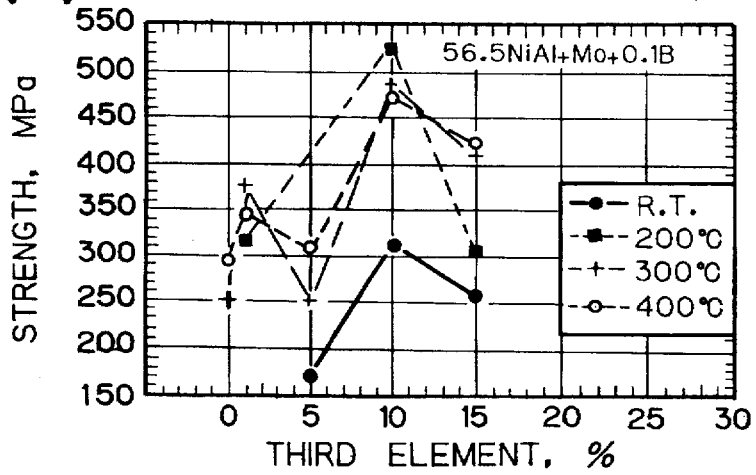
Figure 9D:
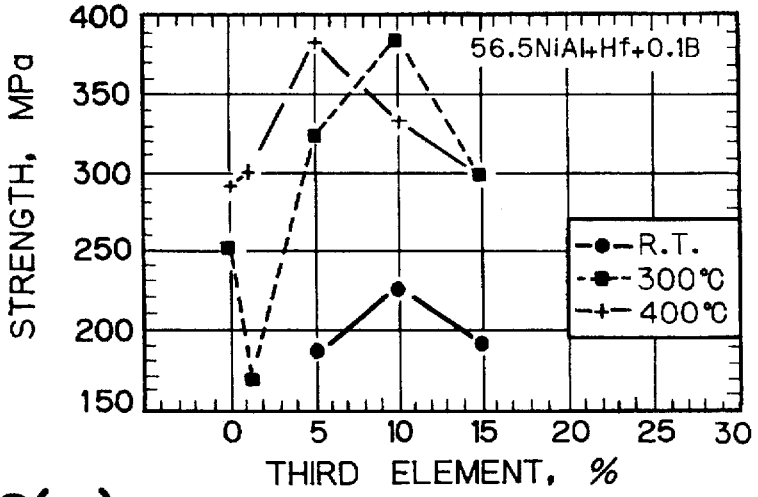
Figure 9E:
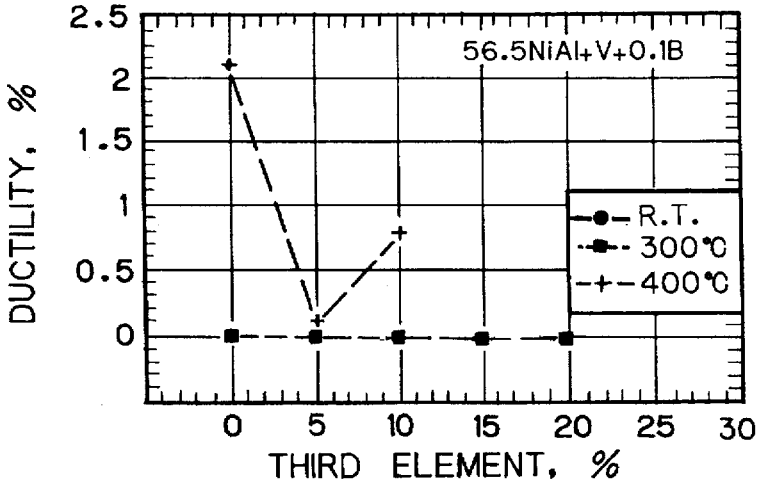
FIGS. 9*e*, 9*f*, 9*g* and 9*h* are graphs showing the ductility characteristic of swaged samples of alloy materials xNiAl+aX +0.1 B, with Mo or W being added as X in amounts of up to 20 at. %.
Figure 9F:
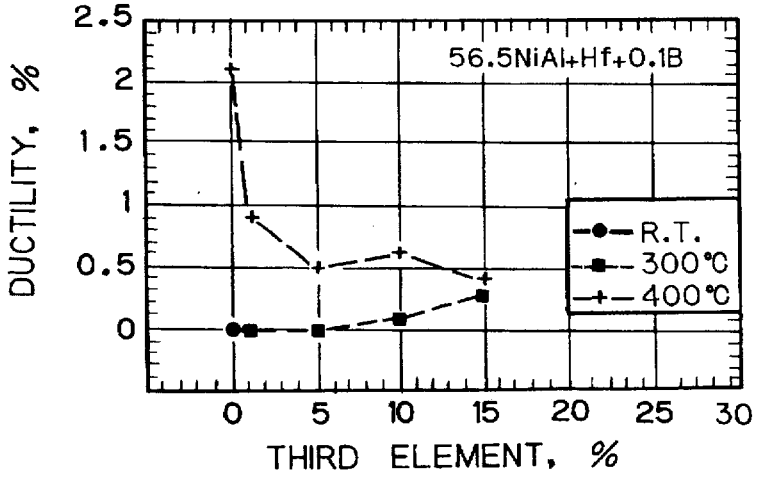
Figure 9G:
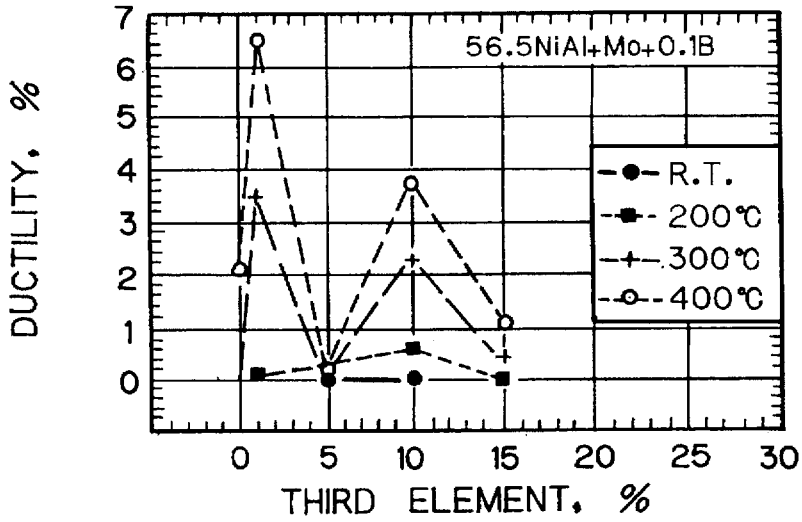
Figure 9H:
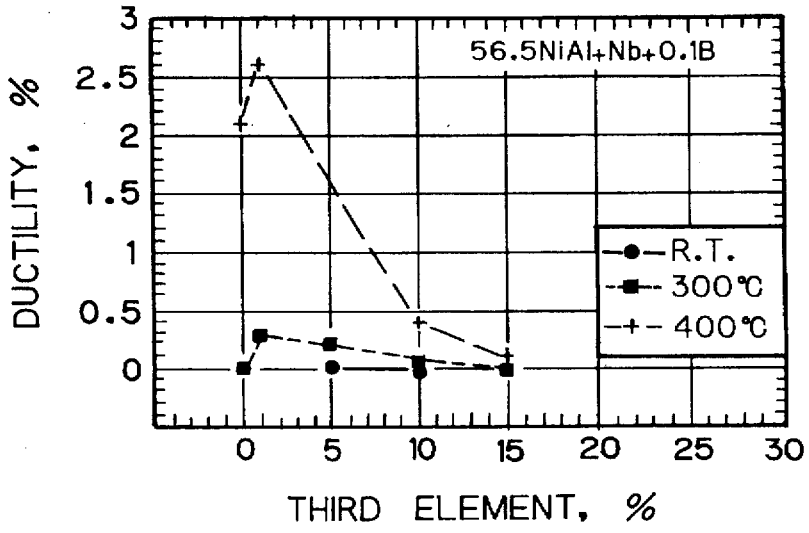

FIGS. 6*a*/6*b* and 7*a*/7*b* show that as the grain size of alloy materials xNiAl+B forged by swaging became finer, their high-temperature strength increased (but decreased when the grain size was as small as a few microns) and the DBTT decreased linearly.

FIGS. 8*a*–8*h* (or 9*a*–9*h*) show that when alloy materials xNiAl+aX+0.2 B forged by swaging contained up to 20 at. % of W (or Mo) as X, their high-temperature strength improved but, on the other hand, their low-temperature ductility was lost. An optimal amount of addition of the third dopant element had to be no more than 1 at. % in order to achieve an improvement in low temperature ductility.

Figure 10A:
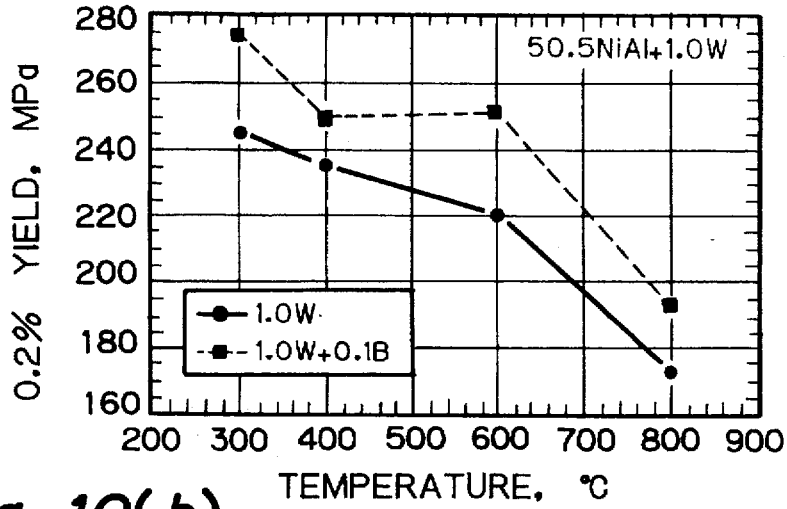
FIGS. 10*a*, 10*b* and 10*c* are graphs showing the effects that were exhibited by swaged samples when they were prepared from alloy materials xNiAl+aX that additionally contained B as a fourth element.
Figure 10B:
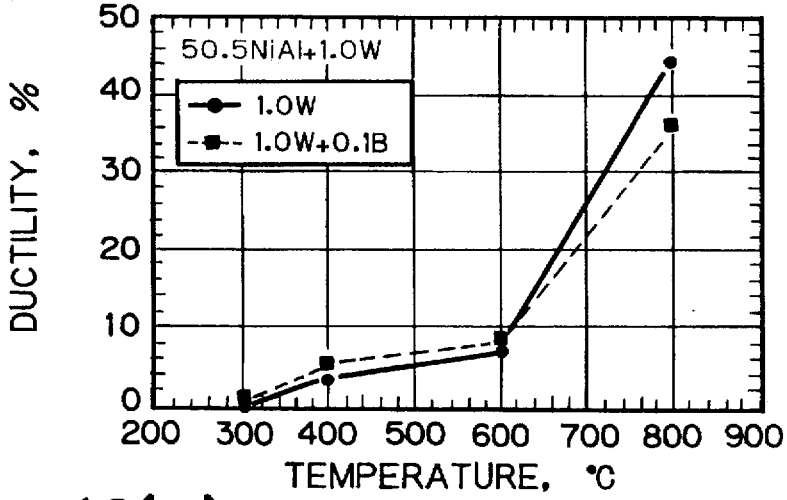
Figure 10C:
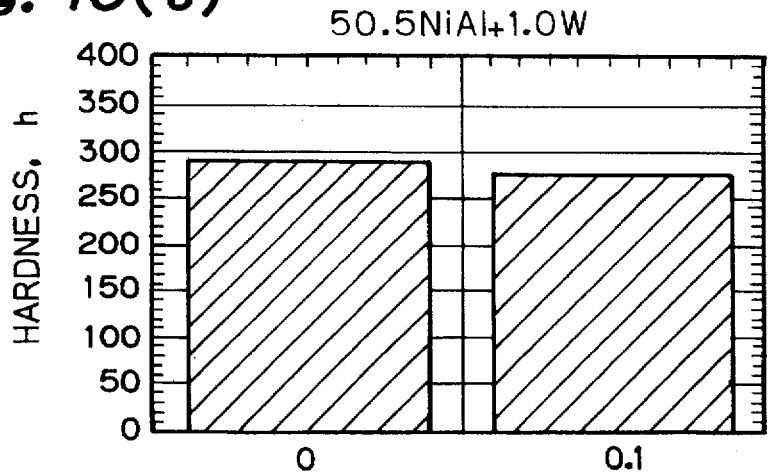

FIGS. 10*a*–10*c* show the effects that were attained when alloy materials xNiAl+aX forged by swaging contained B as the fourth dopant element. Obviously, the addition of B was effective in achieving measurable improvements in hardness, low-temperature elongation and high-temperature strength.

Figure 11:
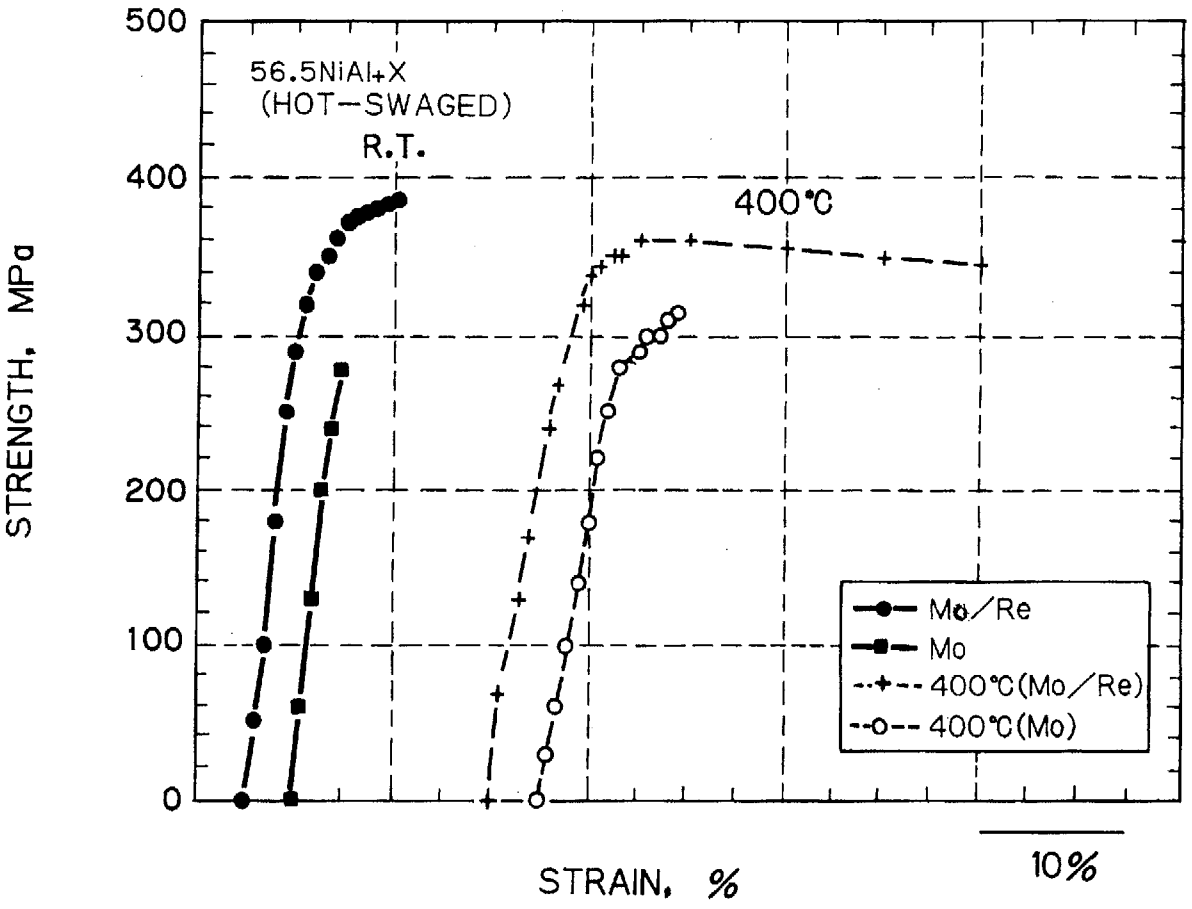
FIG. 11 is a graph showing stress-strain curves at room temperature and 400° C. for the case where Mo was added either alone or as an alloy with Re (Mo/Re) to an alloy material 56.5 NiAl.

FIG. 11 shows that when an alloy material xNiAl+aX+0.2 B forged by swaging contained a Mo/Re alloy as X, an elongation at room temperature was observed although this was not the case when only Mo was added as X.

Comparing the results shown in FIGS. 1–11, one can see that among the alloy materials NiAl+X that were doped with Mo or other elements and which were processed to have a refined structure, the sample that had Mo and Re added in alloy form (see FIG. 11) was particularly satisfactory since it was more ductile at room temperature and exhibited better mechanical strength at high temperature than the conventional NiAl materials.

The materials made of the intermetallic compounds prepared in accordance with the invention have a refined and uniform structure, so they are not only highly ductile at room temperature but also satisfactory in terms of mechanical strength at high temperature; therefore, they can be used as various types of structural materials in engineering, aerospace and nuclear applications.

What is claimed is:

1. A method for producing a space shuttle or nuclear reprocessing structural material consisting essentially of an intermetallic compound having a formula NiAl+xMoRe +cB, wherein the atomic ratio of Ni:Al is 56.5:43.5, the atomic ratio of Mo:Re is 1:1 or 1:0.5, x is between 0.1 and 1 at. %, and c is from 0 to 0.2 at. %, comprising the steps of:

mixing Ni and Al powders in the atomic ratio of 56.5:43.5 in an inert gas adding thereto between 0.1 and 1 at. % total of Mo and Re powders in an atomic ratio of 1:1 or 1:0.5 and from 0 to 0.2 at. % of B and mixing to obtain a uniform powder mixture, packing the mixture in a steel capsule to obtain a packed mixture, and Hot Isostatically Pressing the packed mixture at a temperature from 1000° to 1200° C. with 200 MPa pressure to obtain a pressed material, swaging the pressed material to at least 90% theoretical reduction, thereby obtaining the space shuttle or nuclear reprocessing structural material having a uniform and refined structure.

* * * * *

UNITED STATES PATENT AND TRADEMARK OFFICE

CERTIFICATE OF CORRECTION

PATENT NO.: 5,765,096

DATED: June 9, 1998

INVENTOR(S): Shintaro ISHIYAMA

It is certified that an error appears in the above-identified patent and that said Letters Patent is hereby corrected as shown below:

On the title page, item

[30] Foreign Application Priority Data, delete "Sep. 2, 1995" and insert --Feb. 9, 1995--.

Signed and Sealed this

Nineteenth Day of January, 1999

*Attest:*

*Attesting Officer*

*Acting Commissioner of Patents and Trademarks*